US007406288B2

(12) United States Patent
Nakamoto et al.

(10) Patent No.: US 7,406,288 B2
(45) Date of Patent: Jul. 29, 2008

(54) IMAGE HEATING APPARATUS INCLUDING PADS AND BELTS FORMING A PRESSURIZED NIP

(75) Inventors: Ikuo Nakamoto, Toride (JP); Kazuhiro Hasegawa, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 319 days.

(21) Appl. No.: 11/275,017

(22) Filed: Dec. 1, 2005

(65) Prior Publication Data

US 2006/0127142 A1 Jun. 15, 2006

(30) Foreign Application Priority Data

Dec. 13, 2004 (JP) ..... 2004-359592
Dec. 13, 2004 (JP) ..... 2004-359593

(51) Int. Cl.
*G03G 15/20* (2006.01)

(52) U.S. Cl. ..... 399/329

(58) Field of Classification Search ..... 399/328, 399/329, 341; 219/216
See application file for complete search history.

(56) References Cited

U.S. PATENT DOCUMENTS 5,293,537 A * 3/1994 Carrish ..... 399/329
5,319,429 A * 6/1994 Fukuchi et al. ..... 399/321
5,758,245 A * 5/1998 Matsuura et al. ..... 399/329
5,927,189 A * 7/1999 Jones et al. ..... 101/23
5,970,301 A * 10/1999 De Cock ..... 430/124.3
6,370,352 B1 * 4/2002 Tomita ..... 399/328
6,721,532 B2 * 4/2004 Kosugi et al. ..... 399/341
6,907,221 B2 * 6/2005 Tanino et al. ..... 399/329
7,155,154 B2 * 12/2006 Uehara et al. ..... 399/329
7,155,155 B2 * 12/2006 Uehara et al. ..... 399/329
7,200,354 B2 * 4/2007 Nakamoto et al. ..... 399/329
2006/0285892 A1 12/2006 Nakamoto et al. ..... 399/329

FOREIGN PATENT DOCUMENTS

JP 4-195077 7/1992
JP 5-72926 3/1993
JP 5-127551 5/1993
JP 7-219366 8/1995
JP 07219366 A * 8/1995
JP 9-34291 2/1997
JP 11-174878 7/1999
JP 11174878 A * 7/1999
JP 2002221866 A * 8/2002
JP 2003-295657 10/2003
JP 2004-12734 1/2004

* cited by examiner

*Primary Examiner*—Robert Beatty
(74) *Attorney, Agent, or Firm*—Fitzpatrick, Cella, Harper & Scinto

(57) ABSTRACT

The present invention relates to an image heating device comprising, a first belt which heats an image on a recording material at a nip, a second belt which forms the nip with the first belt, a first pressure member and a first rotating member which press the first belt at the nip, the first pressure member and the first rotating member being provided while not being in contact with each other; and a second pressure member and a second rotating member which press the second belt at the nip, the second pressure member and the second rotating member being provided while not being in contact with each other. The nip is formed by a region where at least one of the first pressure member, the first rotating member, the second pressure member, and the second rotating member is in contact with the corresponding belt.

1 Claim, 12 Drawing Sheets

(a)

(b)

IMAGE HEATING APPARATUS INCLUDING PADS AND BELTS FORMING A PRESSURIZED NIP

BACKGROUND OF THE INVENTION

1. Field of the Invention

The present invention relates to an image heating device which heats an image on a recording material. A fixing device which fixes the image formed on the recording material using an electrophotographic type or an electrostatic recording type or a gloss imparting device which enhances glossiness of the image by re-heating the image fixed to the recording material can be cited as an example of the image heating device. Specifically the image heating device is used for a copying machine, a printer, and a facsimile.

2. Description of the Related Art

In an image forming apparatus such as an electrophotographic apparatus or an electrostatic recording apparatus, the image is formed by transferring and fixing a toner image to a sheet. A roller fixing type is usually used as the fixing device which performs the fixing by heating and melting the unfixed toner image. In the roller fixing type, a pressure roller is pressed against a fixing roller having a heater therein, and a nip is formed to perform the fixing.

In order to output the highly glossy image, it is necessary that a time during which the sheet passes through the nip is lengthened to sufficiently melt the toner. At this point, in the roller fixing type, a roller diameter is required to be increased when the nip is enlarged, which results in upsizing of the apparatus. When a rotating speed of the roller is decreased, the toner is sufficiently melted. However, the speed of the fixing cannot be increased.

Therefore, Japanese Patent Application Laid-Open (JP-A) Nos. 11-174878 and 05-072926 disclose an upper-and-lower-belt fixing type in which a sufficient width of pressure contact portion (length in conveyance direction) while the miniaturization and speed enhancement of the apparatus are achieved compared with the roller fixing type. In the above disclosures, the fixing device includes two opposing belt members, and the large width of the pressure contact portion is obtained by sandwiching and conveying the sheet with the belt members.

However, in the fixing device disclosed in JP-A Nos. 11-174878 and 05-072926, a region where high pressure is generated by pressing support members against each other and a region where the pressure is absent because no support member presses the belt from both sides of the belt exist in the pressure contact portion. Therefore, when the unfixed toner image is fixed, a conveyance speed difference of the sheet is generated between the high-pressure region and the pressure-absence region. Because the belt member has flexibility to some extent, there is a problem that the belt is expanded and compressed by the conveyance speed difference to shift the image on the sheet. Further, because air and moisture in a toner layer cannot be suppressed in the pressure-absence region, image disturbance is easy to occur in the sheet such as a coated sheet in particular having low permeability.

SUMMARY OF THE INVENTION

In view of the foregoing, an object of the invention is to provide an image heating device in which a nip which heats a recording material can well be formed.

Another object of the invention is to provide an image heating device in which a pressure of the nip which heats the recording material can be improved.

One aspect of the invention provides an image heating device including a first belt which heats an image on a recording material at a nip; a second belt which forms the nip with the first belt; a first pressure member and a first rotating member which press the first belt at the nip, the first pressure member and the first rotating member being provided while not being in contact with each other; and a second pressure member and a second rotating member which press the second belt at the nip, the second pressure member and the second rotating member being provided while not being in contact with each other, wherein the nip is formed by a region where at least one of the first pressure member, the first rotating member, the second pressure member, and the second rotating member is in contact with the corresponding belt.

Further, another aspect of the invention provides an image heating device including a first belt which heats an image on a recording material at a nip; a second belt which forms the nip with the first belt; a first pressure member which presses the first belt at the nip; and a second pressure member and a third pressure member which press the second belt at the nip, the second pressure member and the third pressure member being sequentially arranged in a recording material conveyance direction, wherein the second pressure member and the third pressure member are arranged so as to sandwich the first belt and the second belt while being opposite the first pressure member.

Further objects of the invention will be apparent from the following description with reference to the accompanying drawing wherein:

DESCRIPTION OF THE PREFERRED EMBODIMENT

Then, the invention will be described more specifically by means of embodiments. The following embodiments are shown by way of just example of preferred embodiments, and the invention shall not be limited to the embodiments.

First Embodiment

A fixing device and an image forming apparatus according to a first embodiment of the present invention will be described. First an entire configuration of an image forming apparatus will be described with reference to FIG. 6.

Figure 6:
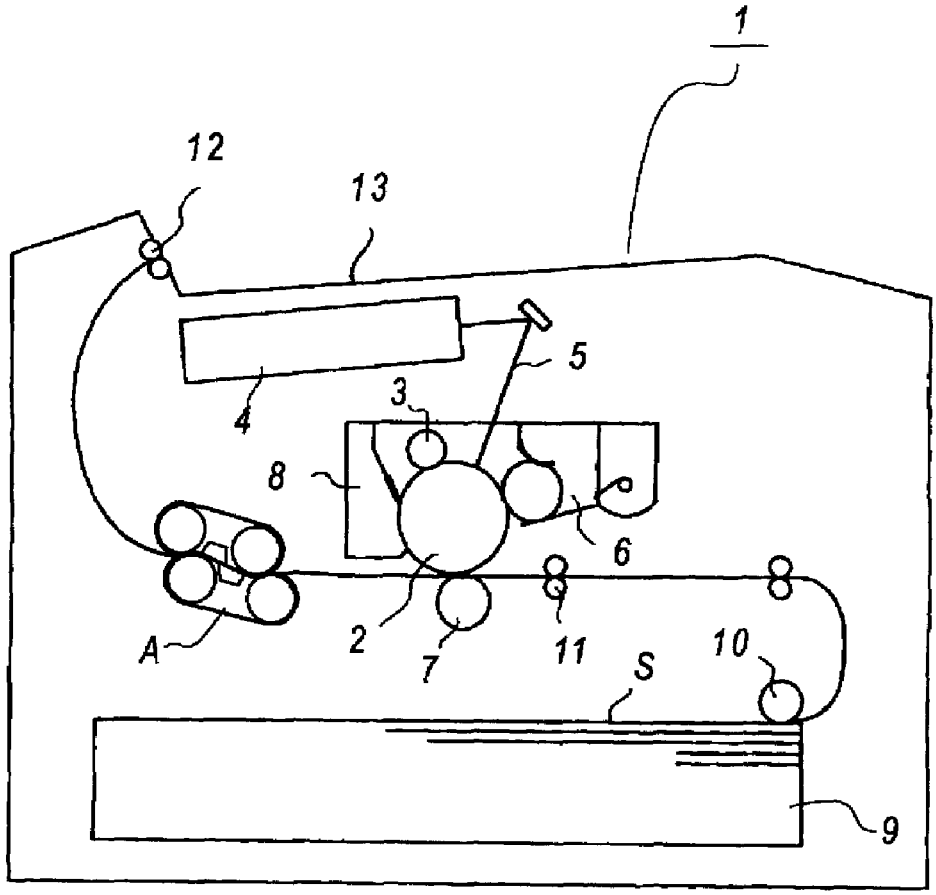
FIG. 6 is a view explaining an entire configuration of an image forming apparatus.

The image forming apparatus shown in FIG. 6 is the image forming apparatus (so-called printer) in which the electrophotographic type is adopted.

An image forming apparatus 1 includes a photosensitive drum 2 which is of the image bearing member for bearing a latent image. The photosensitive drum 2 is uniformly charged by a charger 3, and the latent image is formed by irradiating the photosensitive drum 2 with a light beam 5 from an optical device 4. The latent image is developed to form the toner image by a development unit 6 which is of the development means for developing the latent image. The toner image is transferred to the sheet by a transfer roller 7 which is of the transfer means, and the toner remaining on the photosensitive drum 2 is removed by a cleaning device 8.

Sheets S are provided in a sheet cassette 9 in a lower portion of the image forming apparatus, and the sheet S is fed by a sheet roller 10. The sheet is conveyed in synchronization with the image on the photosensitive drum 2 by a registration roller pair 11 which is of the conveyance means. The sheet S is conveyed to the fixing device A after the toner image is transferred. Then, the toner image is fixed to the sheet S by the heating and the pressure in the fixing device A, and the sheet S is discharged to and stacked on a discharge tray 13 in an upper portion of the apparatus by a discharge roller pair 12.

Figure 1:
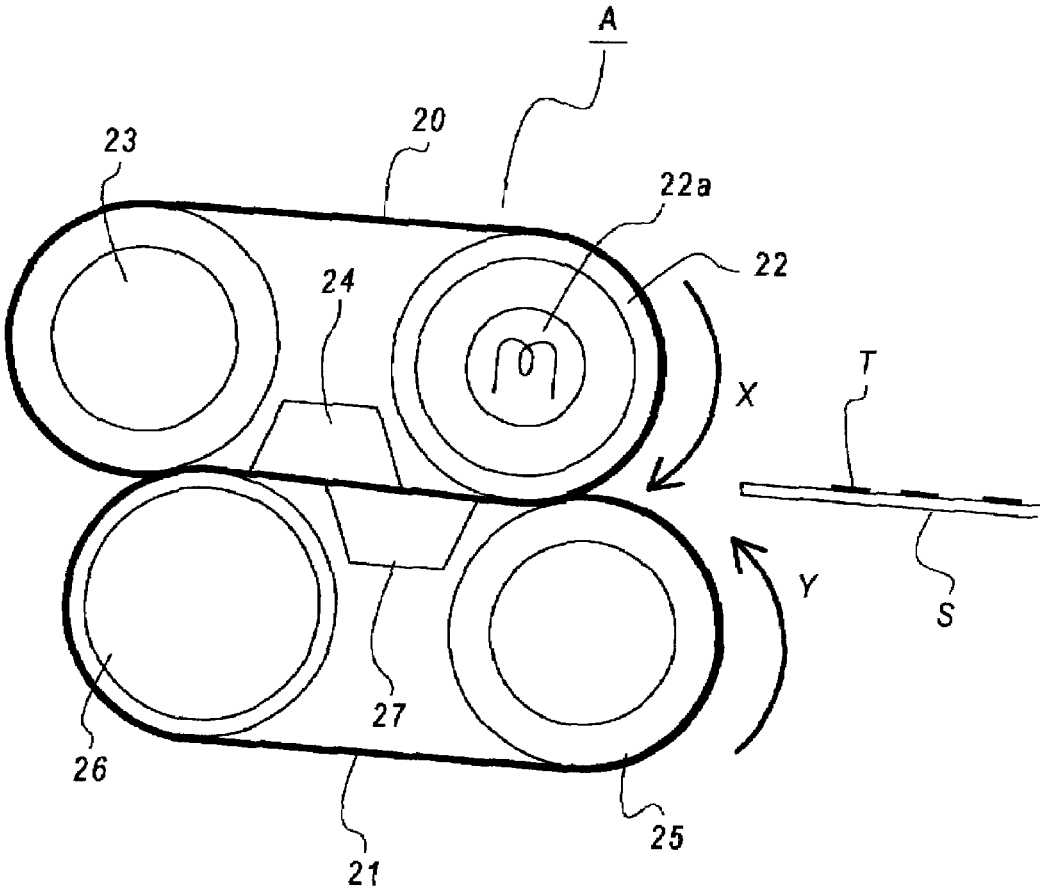
FIG. 1 is a sectional view showing a fixing device according to a first embodiment of the invention.
Figure 2:
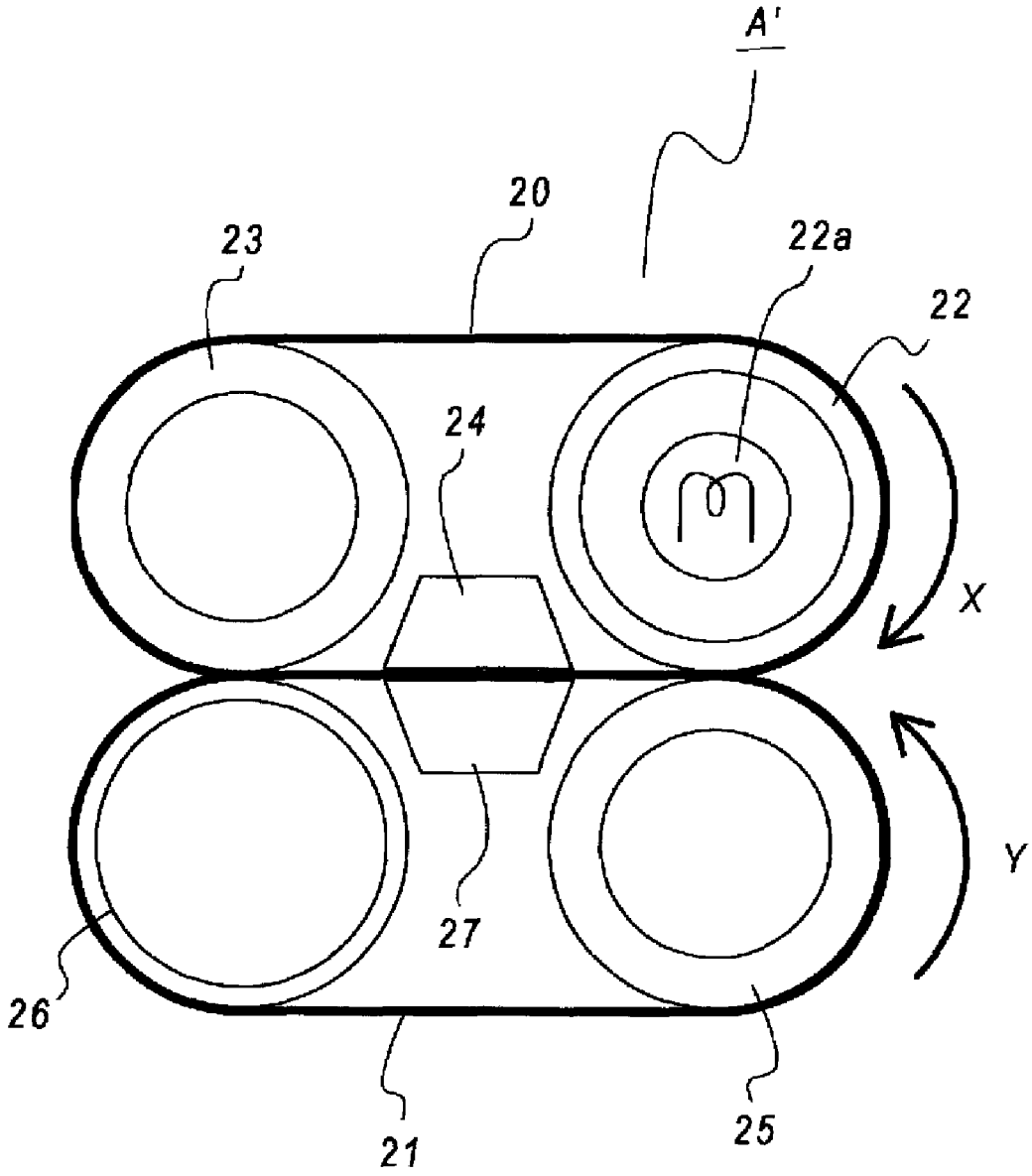
FIG. 2 is a sectional view explaining a comparative example of the first embodiment.

FIG. 1 is a sectional view showing the fixing device A according to the first embodiment, and FIG. 2 is a sectional view explaining a comparative example. As shown in FIGS. 1 and 2, the fixing device A includes a fixing belt 20 which is of the first belt and a pressure belt 21 which is of the second belt. In the fixing belt 20, a base layer is made of polyimide having an inner diameter of 34 mm and a thickness of 75 μm, and a heat-resistant silicone rubber layer having the thickness of 300 μm which is of an elastic layer is provided in an outer circumference of the base layer. In the silicone rubber, hardness is 20 degrees (JIS-A), and heat conductivity is 0.8 W/mK. A fluororesin layer (for example, PFA or PTFE) having the thickness of 30 μm which is of a surface tonner-parting layer is further provided in the outer circumference of the elastic layer. In the pressure belt 21, the base layer is made of polyimide having the inner diameter of 34 mm and the thickness of 75 μm, and a PFA tube made of fluororesin having the thickness of 30 μm is provided as the mold-releasing layer in the surface.

The fixing belt 20 is suspended by a fixing roller 22 and a pressure roller 23 (first roller). The fixing roller 22 is an iron hollow roller having the thickness of 1 mm. The outer diameter of the fixing roller 22 is 20 mm and the inner diameter is 18 mm. A halogen heater 22*a* which is of the heating means is arranged inside the fixing roller 22. In the pressure roller 23, in order to decrease the heat conductivity to suppress heat conduction from the fixing belt 20, a silicone rubber sponge layer is provided on an iron-alloy cored bar having the outer diameter of 20 mm and the inner diameter of 16 mm. The hardness of the pressure roller 23 in the center of a longitudinal direction is about 60 degrees by an ASK-C hardness tester. The pressure roller 23 is rotated by a motor (not shown), and the rotation fixing belt 20 is driven by friction between the silicone rubber sponge surface of the pressure roller 23 and the inner surface polyimide layer of the fixing belt 20.

A pressure pad 24 which is of the first pressure member supporting the fixing belt 20 is closely arranged between the fixing roller 22 and the pressure roller 23 while located about 1 mm away from each of the fixing roller 22 and the pressure roller 23. The pressure pad 24 is formed by the elastic body made of the heat-resistant silicone rubber having the thickness of 3 mm and the width of 8 mm. The pressure pad 24 is fixedly arranged while being slidable to the fixing belt 20.

The pressure belt 21 is suspended by a pressure roller 25 and a pressure roller 26 (second roller). The pressure roller 25 is arranged on an upstream side of the pressure contact portion and the pressure roller 26 is arranged on a downstream side of the pressure contact portion. The pressure roller 25 arranged on the upstream side of the pressure contact portion is equal to the pressure roller 23 arranged in the fixing belt 20. In the pressure roller 25, in order to decrease the heat conductivity to suppress the heat conduction from the fixing belt 20, the silicone rubber sponge layer is provided on the iron-alloy cored bar having the outer diameter of 20 mm and the inner diameter of 16 mm. In the pressure roller 26 arranged on the downstream side of the pressure contact portion, the silicone rubber layer having the thickness of 0.3 mm is provided on the iron-alloy cored bar having the thickness of 1 mm and the outer diameter of 20 mm. That is, the pressure roller 26 is configured to have rigidity higher than that of the pressure roller 23 opposite to the pressure roller 26.

A pressure pad 27 which is of the second pressure member supporting the fixing belt 21 is closely arranged between the fixing roller 25 and the pressure roller 26 while located about 1 mm away from each of the fixing roller 25 and the pressure roller 26. Similarly to the pressure pad 24, the pressure pad 27 is formed by the elastic body made of the heat-resistant silicone rubber having the thickness of 3 mm and the width of 8 mm. The pressure pad 27 is fixedly arranged while being slidable to the fixing belt 21.

At least in performing the image formation, the pressure roller 23 is rotated by drive means (not shown) to rotate the fixing belt 20 in an arrow X direction of FIG. 1. A circumferential speed of the fixing belt 20 is substantially equal to the conveyance speed of the sheet S which is conveyed from the image transfer portion side. The pressure belt 21 is driven in accordance with the fixing belt 20, or the pressure belt 21 is rotated in the arrow Y direction by driving the pressure roller 26 such that the circumferential speeds of the fixing belt 20 and the pressure belt 21 become equal to each other. In the first embodiment, the surface rotating speed of the fixing belt 20 is 300 mm/sec, and 70 A4-size full-color images can be fixed for one minute.

In the temperature-adjusted state in which the fixing belt 20 reaches to a predetermined fixing temperature, the sheet S having an unfixed toner image T is conveyed between the fixing belt 20 and the pressure belt 21 in the pressure contact portion. The sheet S is introduced while the surface on which the unfixed toner image is borne is orientated toward the side of the fixing belt 20. The unfixed toner image side of the sheet S comes into close contact with the circumferential surface of the fixing belt 20, and the pressure contact portion is sandwiched and conveyed with the fixing belt 20. Therefore, the heat of the fixing belt 20 is imparted, and the unfixed toner image T is thermally fixed onto the surface of the sheet S by receiving the pressing force of the pressure contact portion.

Since the rigidity of the pressure roller 26 located on the downstream side in the pressure belt 21 is higher than that of the pressure roller 23 in the fixing belt 20, deformation of the pressure roller 23 becomes large at an exist of the pressure contact portion between the fixing belt 20 and the pressure belt 21, the resultant large deformation of the fixing belt 20 enables the toner image to be separated by itself from the fixing belt 20 to well separate and convey the sheet.

In this case, the fixing roller 22, the pressure roller 23, and the pressure pad 24 correspond to the support member inside the pressure belt 21. The pressure roller 25, the pressure roller 26, and the pressure pad 27 correspond to the support member inside the fixing roller 22. Although these components are closely arranged, the pressure-absence region is generated when gaps are arranged opposite to each other.

Therefore, in the first embodiment, the fixing belt 20 and pressure belt 21, which are arranged substantially symmetrically as a support member, are shifted from each other by a predetermined amount in the conveyance direction. Accordingly, the pressure roller 26 on the downstream side of the pressure belt 21 faces the gap located between the pressure roller 23 and the pressure pad 24 in the fixing belt 20, and the pressure roller 26 is arranged so as to press the gap. In the first embodiment, the pressure roller 26 is arranged so as to press both the pressure roller 23 and the pressure pad 24.

Similarly the pressure pad 24 on the upstream side of the fixing belt 20 is arranged so as to press the gap located between the pressure roller 26 and the pressure pad 27 in the pressure belt 21. That is, the pressure pad 24 is arranged so as to press both the pressure roller 26 and the pressure pad 27.

The pressure pad 27 in the pressure belt 21 is arranged so as to press the gap located between the fixing roller 22 and the pressure pad 24 in the fixing belt 20. That is, the pressure pad 27 is arranged so as to press both the fixing roller 22 and the pressure pad 24.

The fixing roller 22 in the fixing belt 20 is arranged so as to press the gap located between the pressure roller 25 and the pressure pad 27 in the pressure belt 21. That is, the fixing roller 22 is arranged so as to press both the pressure roller 25 and the pressure pad 27.

The fixing device A having the above configuration, the width in the belt rotating direction (length in conveyance direction) of the pressure contact portion between the fixing belt 20 and the pressure belt 21 becomes about 25 mm. Since the width is wide, the fixing can sufficiently be performed even if the sheet is conveyed at high speed.

Since the support member inside one of the fixing belt 20 and the pressure belt 21 is configured to press the gap of the support member inside the other, the pressure-absence region is not generated. Accordingly, although the pressure contact portion has the large width, the conveyance speed difference is not generated nor is generated the image shift. In the configuration of the first embodiment, when the presence or absence of the image shift generation is confirmed with the coated sheet having the low permeability, the image shift is not generated.

Further, since the pressure pads 24 and 27 are formed by the elastic body, the pressure in the nip becomes the maximum at the opposite portion between the fixing roller 23 and the pressure roller 26. Therefore, when the belts are driven by the upper and lower rollers respectively, both the belts can stably be rotated with no slip.

On the contrary, FIG. 2 is a sectional view explaining a comparative example in which the fixing roller 22, the pressure roller 23, and the pressure pad 24 face the pressure roller 25, the pressure roller 26, and the pressure pad 27 respectively. In the configuration of a fixing device A' shown in FIG. 2, the gaps of the support members are opposite to each other, and the pressure-absence region exists at the gap. In the comparative example, when the coated sheet is caused to pass through the fixing device A', the generation of the image shift is confirmed.

In the first embodiment, since the fixing belt 20 is shifted toward the downstream side in the conveyance direction with respect to the pressure belt 21, the nips are continuously formed in the order of the pressure pad 27, the pressure pad 24, the pressure roller 26, and the pressure roller 23. Alternatively, the fixing belt 20 may be shifted toward the upstream side in the conveyance direction. In this case, the nips are continuously formed in the order of the pressure pad 24, the pressure pad 27, the pressure roller 23, and the pressure roller 26.

Second Embodiment

Figure 3:
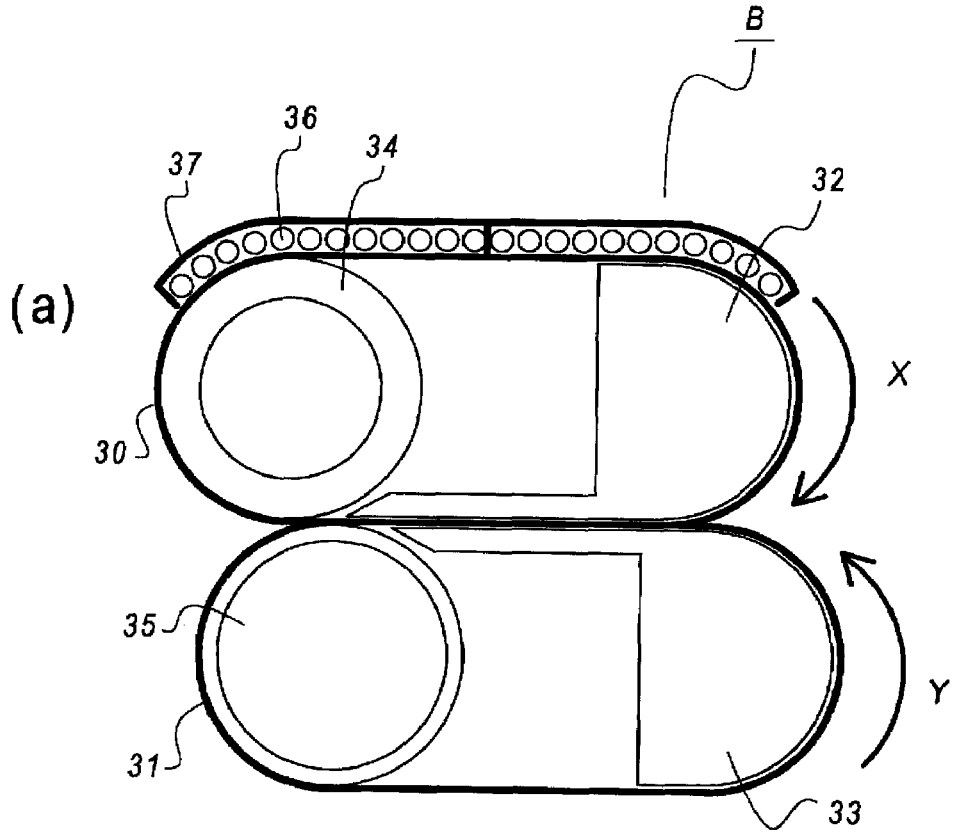
FIG. 3A is a view showing a fixing device according to a second embodiment of the invention.
FIG. 3B is a view showing a fixing device according to a second embodiment of the invention.
Figure 3:
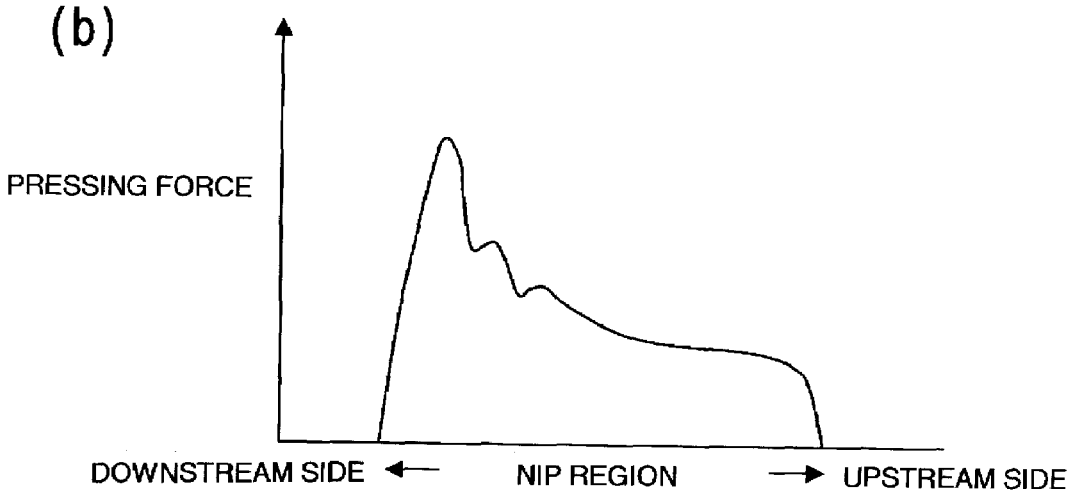
Figure 4:
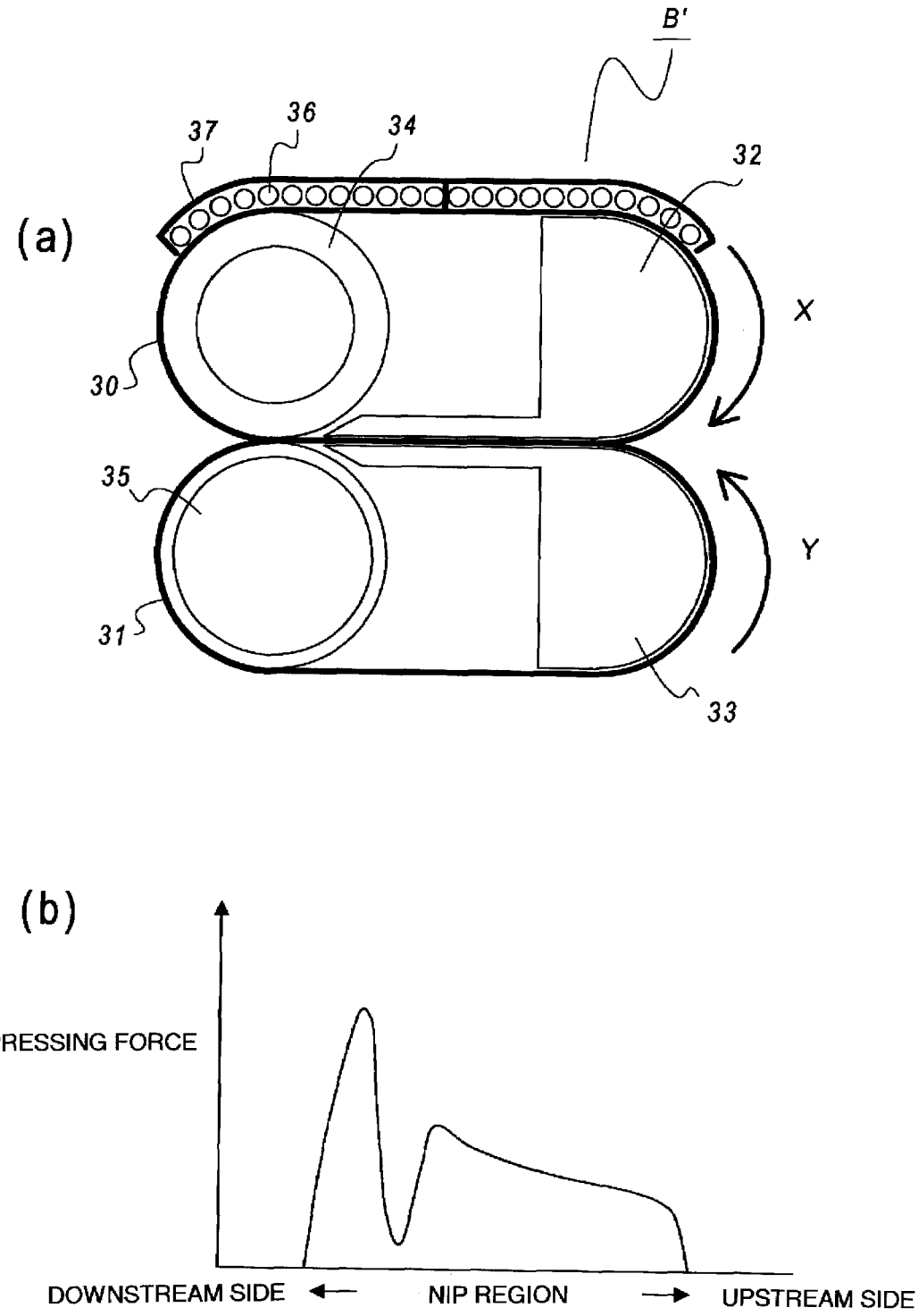
FIG. 4A is a view explaining a comparative example of the second embodiment.
FIG. 4B is a view explaining a comparative example of the second embodiment.

A fixing device and an image forming apparatus according to a second embodiment of the invention will be described below. FIG. 3 is a sectional view showing a fixing device B according to the second embodiment, and FIG. 4 is a sectional view explaining a comparative example. In the second embodiment, the component overlapping the first embodiment is designated by the same numeral, and the description will not be shown. In the second embodiment, an image forming apparatus 1 is provided with the fixing device B which will be described below instead of the fixing device A.

In a fixing belt 30 which is of the first belt in the fixing device B, the base layer is made of nickel produced by electro-casting, and the base layer has the inner diameter of 34 mm and the thickness of 50 μm. The heat-resistant silicone rubber layer having the thickness of 300 μm which is of the elastic layer is provided in the outer circumference of the base layer. In the silicone rubber, the hardness is 20 degrees (JIS-A), and the heat conductivity is 0.8 W/mK. The fluororesin layer (for example, PFA or PTFE) having the thickness of 30 μm which is of the surface mold-releasing layer is further provided in the outer circumference of the elastic layer. In order to decrease slide friction with a later-mentioned belt guide member 32, a resin layer made of fluororesin or polyimide may be provided with the thickness ranging from 10 to 50 μm in the inner surface of the base layer. The polyimide layer having the thickness of 20 μm is provided in the second embodiment. When the inner surface of the fixing belt 30 is in contact with an electrically conductive inclusion, in order to effectively pass induction current through the metal fixing belt base layer, it is desirable that an electric insulating layer exists in the inner surface of the fixing belt 30. In addition to nickel, the iron alloy, copper, silver and the like can appropriately be selected for the fixing belt 30. It is also possible that the metal is laminated on the resin base layer. The metal layer thickness can be adjusted according to a frequency of high-frequency current passed through a later-mentioned induction heating coil and magnetic permeability and electrical conductivity of the metal layer, and the metal layer thickness is set in the range of 5 to 200 μm.

In a pressure belt 31 which is of the second belt in the fixing device B, the base layer is made of polyimide having the inner diameter of 34 mm and the thickness of 75 μm, and the PEA tube made of fluororesin having the thickness of 30 μm is provided as the mold-releasing layer in the surface. In order to decrease the slide friction with a later-mentioned belt guide member 33, fluororesin particles may be dispersed in polyimide which is of the base layer.

The fixing belt 30 is supported by the belt guide member 32 and a pressure roller 34.

The belt guide member 32 is made of a resin having elasticity, and the belt guide member 32 is made of a poly phenylene sulfide resin (PPS) in the second embodiment. The belt guide member 32 imparts tension of about 49N to the fixing belt 30. In the belt guide member 32, a rib is provided in a portion which is in contact with the inner surface of the fixing belt 30 in order to decrease an area of the belt guide member 32 which is in contact with the inner surface of the fixing belt 30 to decrease the frictional resistance. Another purpose of the provision of the rib is that only the fixing belt 30 is efficiently kept at a high temperature while the area which is in contact with the inner surface of the fixing belt 30 is decreased to decrease the heat conduction from the heated fixing belt 30. However, because the belt guide member 32 presses the pressure contact portion between the fixing belt 30 and the pressure belt 31, the rib does not exist in the pressure contact portion of the belt guide member 32.

The use of the belt guide member 32 which is of the fixed member enables a heat conduction amount from the belt inner surface to be decreased compared with the rotating roller, so that a warm-up time is shortened. This is because, when compared with the fixed guide member, in the rotating roller, the heat conduction amount from the belt inner surface is increased by repeating a cycle of endotherm from the belt inner surface to the roller surface when the roller is in contact with the belt inner surface, heat dissipation when the roller is separated from the belt inner surface by the rotation, and the endotherm from the belt inner surface after the rotation.

The use of the belt guide member 32 also enables the two members of the roller and the pad to be continuously arranged, so that the pressure-absence region is not generated.

In the pressure roller 34, the silicone rubber sponge layer is provided in the iron-alloy cored bar in order to decrease the heat conductivity to suppress the heat conduction from the fixing belt 30. In iron-alloy cored bar, the outer diameter is 20 mm, the diameter in the center of the longitudinal direction is 16 mm, and the diameters of the both end portions are 14 mm. The hardness of the pressure roller 34 in the center of the longitudinal direction is about 60 degrees by the ASK-C hardness tester. The reason why the cored bar is tapered is that the width of the pressure contact portion between the pressure roller 34 and a pressure roller 35 becomes uniform in the longitudinal direction even if the pressure roller 34 is bent when heated. The belt guide member 32 and the pressure roller 34 are arranged while located about 1 mm away from each other. The pressure roller 34 is rotated by a motor (not shown), and the fixing belt 30 is rotated by the friction between the silicone rubber sponge surface of the pressure roller 34 and the inner surface polyimide layer of the fixing belt 30.

The pressure belt 31 is supported by the belt guide member 33 and the pressure roller 35.

The belt guide member 33 is made of the resin having elasticity, and the belt guide member 33 is made of PPS in the second embodiment. The belt guide member 33 imparts tension of about 49N to the pressure belt 31. In the belt guide member 33, the rib is provided in a portion which is in contact with the inner surface of the pressure belt 31 in order to decrease the area of the belt guide member 33 which is in contact with the inner surface of the pressure belt 31 to decrease the frictional resistance. However, because the belt guide member 33 presses the pressure contact portion between the fixing belt 30 and the pressure belt 31, the rib does not exist in the pressure contact portion of the belt guide member 33.

The use of the belt guide member 33, which is of the fixed member, enables the two members of the roller and the pad to be continuously arranged. Therefore, the pressure-absence region is not generated.

In the pressure roller 35, the silicone rubber layer having the thickness of 0.3 mm is provided in the iron-alloy cored bar having the outer diameter of 20 mm and the thickness of 1.0 mm. The belt guide member 33 and the pressure roller 35 are arranged while located about 1 mm away from each other. The pressure roller 35 is rotated by a motor (not shown), and the pressure belt 31 is rotated by the friction between the silicone rubber surface of the pressure roller 35 and the polyimide layer of the pressure belt 31.

The fixing device B having the above configuration, the width in the belt rotating direction (length in conveyance direction) of the pressure contact portion between the fixing belt 30 and the pressure belt 31 becomes about 25 mm. Since the width is wide, the fixing can sufficiently be performed even if the sheet is conveyed at high speed.

The belt guide member 33 is pressed against the belt guide member 32 at about 98N, and the pressure roller 35 is pressed against the pressure roller 34 at about 294N. At this point, because the pair of belt guide members 32 and 33 in the pressure contact portion is higher than the roller pair 34 and 35 in the pressure per unit area, when the belts are driven by the upper and lower rollers respectively, both the belts can stably be rotated with no slip.

Since the hardness of the pressure roller 35 is higher than that of the pressure roller 34, the deformation of the pressure roller 34 becomes large at the exit of the pressure contact portion between the fixing belt 30 and the pressure belt 31, the resultant large deformation of the fixing belt 30 enables the toner image to be separated by itself from the fixing belt 30 to well separate and convey the sheet.

An induction heating coil 36 which is of a heat source of the fixing belt 30 is covered with a magnetic core 37 such that a magnetic field generated by the induction heating coil 36 does not leak outside the metal layer of the fixing belt 30. Further, the induction heating coil 36 and the magnetic core 37 are integrally molded with an electric insulating resin. The electric insulating state is kept between the fixing belt 30 and the induction heating coil 36 by the 0.5 mm mold, and a distance between the fixing belt 30 and the induction heating coil 36 is kept constant at 1.5 mm (distance between the mold surface and the fixing belt surface is 1.0 mm), so that the fixing belt 30 is uniformly heated. The induction heating coil 36 is formed such that the length along the sheet-pass direction of the sheet S (direction orthogonal to the conveyance direction of the sheet S) is longer than the sheet-pass width of the sheet S having the maximum sheet-pass width used in the image formation. The high-frequency current ranging from 20 to 50 kHz is passed through the induction heating coil 36 to generate the induced heat in the metal layer of the fixing belt 30. The temperature is adjusted so as to be kept constant at 170° C., which is a target temperature of the fixing belt 30, by changing the frequency of the high-frequency current to control electric power inputted to the induction heating coil 36 based on a detection value of a temperature sensor. The silicone rubber sponge layer of the pressure roller 34 has the thickness of at least 2 mm, and the cored bar is hardly heated by the induction heating coil 36. Therefore, in the second embodiment, only the fixing belt 30 can efficiently be heated. The temperature sensor is attached to the belt guide member 32. The temperature sensor is in contact with the position where the heat generation amount by the induction heating coil 36 which is inner surface of the fixing belt 30 becomes the maximum, and the temperature sensor detects the temperature of the position.

At least in performing the image formation, the pressure roller 34 is rotated by drive means (not shown) to rotate the fixing belt 30 in an arrow X direction. The pressure belt 31 is similarly driven and rotated in an arrow Y direction by rotating the pressure roller 35 with drive means (not shown). The circumferential speeds of the fixing belt 30 and the pressure belt 31 are substantially equal to the conveyance speed of the sheet S' which is conveyed from the image transfer portion side. In the second embodiment, the surface rotating speeds of the fixing belt 30 and the pressure belt 31 are 300 mm/sec, and 70 A4-size full-color images can be fixed for one minute.

In the temperature-adjusted state in which the fixing belt 30 reaches to the predetermined fixing temperature, the sheet S having the unfixed toner image T is conveyed between the fixing belt 30 and the pressure belt 31 in the pressure contact portion. The sheet S is introduced while the surface on which the unfixed toner image is borne is orientated toward the side of the fixing belt 30. The unfixed toner image side of the sheet S comes into close contact with the circumferential surface of the fixing belt 30, and the pressure contact portion is sandwiched and conveyed with the fixing belt 30. Therefore, the heat of the fixing belt 30 is mainly imparted, and the unfixed toner image T is thermally fixed onto the surface of the sheet S by receiving the pressing force of the pressure contact portion.

The pressure belt 31 can be moved by a cam (not shown) so as to be brought into contact with and separated from the fixing belt 30. The pressure belt 31 is separated from the fixing belt 30 by this mechanism except during the fixing operation. Therefore, since the heat of the fixing belt 30 is not transferred to the pressure belt 31, when the electric power of 1200 W is inputted to the induction heating coil 36, about 18-second warm-up time of the fixing device B is required to heat the fixing belt 30 to 170° C. which is of the target temperature in the state where the pressure belt 31 is separated from the fixing belt 30.

In this case, the belt guide member 32 and the pressure roller 34 correspond to the support member inside the fixing belt 30. The belt guide member 33 and the pressure roller 35 correspond to the support member inside the pressure belt 31. Although these components are closely arranged, the pressure-absence region is generated when the gaps are arranged opposite to each other.

Therefore, in the second embodiment, the fixing belt 30 and pressure belt 31, which are arranged substantially symmetrically as a support member, are shifted from each other by a predetermined amount in the conveyance direction. Accordingly, the pressure roller 35 of the pressure belt 31 faces the gap located between the belt guide member 32 and the pressure roller 34 in the fixing belt 30, and the pressure roller 35 is arranged so as to press the gap. In the second embodiment, the pressure roller 35 is arranged so as to press both the belt guide member 32 and the pressure roller 34.

At the same time, the belt guide member 32 of the fixing belt 30 is arranged so as to press the gap located between the belt guide member 33 and the pressure roller 35. That is, the belt guide member 32 is arranged so as to press both the belt guide member 33 and the pressure roller 35.

Since the support member inside one of the fixing belt 30 and the pressure belt 31 is configured to press the gap of the support member inside the other, the pressure-absence region is not generated. FIG. 3B shows a pressing force distribution at the pressure contact portion in the configuration of the second embodiment. As can be seen from FIG. 3B, the large pressure-absence region does not exist and the pressure is gradually increased from the upstream side. Accordingly, although the pressure contact portion has the large width, the conveyance speed difference is not generated nor is generated the image shift. In the configuration of the second embodiment, when the presence or absence of the image shift generation is confirmed with the coated sheet having the low permeability, the image shift is not generated.

On the contrary, FIG. 4A shows a comparative example in which the belt guide member 32 and the pressure roller 34 face the belt guide member 33 and the pressure roller 35 respectively. In the configuration of a fixing device B' shown in FIG. 4A, the gaps between the support members are opposite to each other. FIG. 4B shows a pressing force distribution at the pressure contact portion in the configuration of the comparative example. As can be seen from FIG. 4B, the large pressure-absence region exists in the region where the gaps between the support members are opposite to each other. In the comparative example, when the coated sheet having the low permeability is caused to pass through the fixing device B', the generation of the image shift is confirmed.

Thus, in the second embodiment, the fixing belt and the pressure belt are supported by the pressure roller and the belt guide. Therefore, the fixing belt having the small diameter and small heat capacity can be heated with little excess heat conduction and the warm-up time can be shortened. Since the sheet is conveyed at the region on the downstream side of the pressure contact portion where the pressure is relatively high while the fixing belt and the pressure belt are sandwiched by the roller pair, the belt slip can be prevented. Further, the two support members forming the nip in one of the belts are arranged so as to be pressed by the support member in the other belt, so that the generation of the image shift can be prevented.

Third Embodiment

In addition to the fixing devices having the configurations described in the above embodiments, the invention can also be applied to any fixing device including the pressure means in which at least two support members forming the nip in one of the belts are pressed by the support member in the other belt. Therefore, the width (length in the conveyance direction) in the belt rotating direction of the pressure contact portion is secured, and the generation of the pressure-absence region can be suppressed to prevent the image shift while the speed enhancement of the fixing is achieved.

Figure 5:
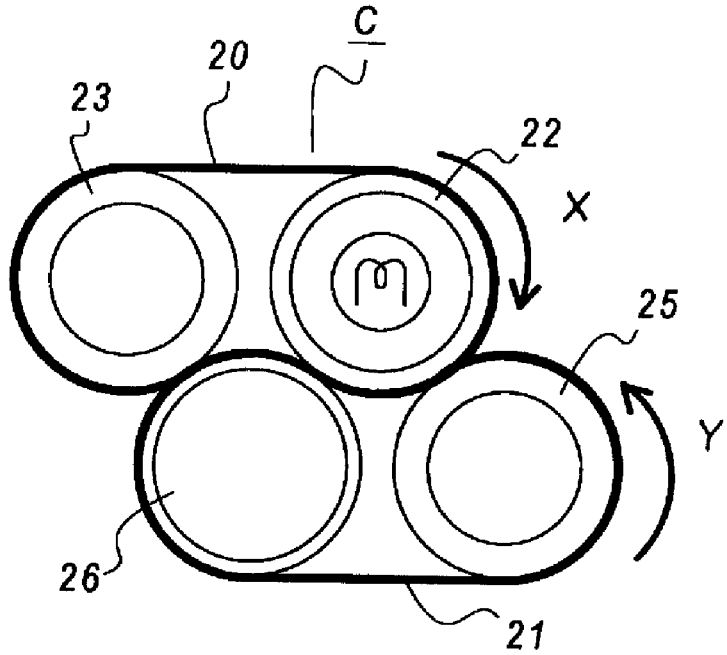
FIG. 5A is a view explaining a fixing device according to a third embodiment of the invention.
FIG. 5B is a view explaining a fixing device according to a third embodiment of the invention.
Figure 5:
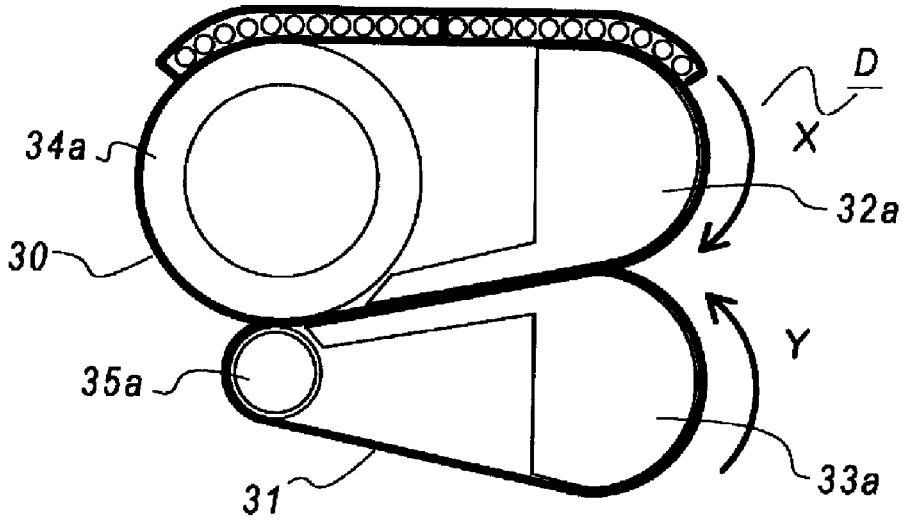

FIG. 5 is a view briefly showing a fixing device according to a third embodiment. A fixing device C shown in FIG. 5A does not includes the pressure pads 24 and 27 compared with the configuration of the first embodiment. Alternatively, the distance between the axes of the fixing roller 22 and the pressure roller 23 and the distance between the axes of the pressure roller 25 and the pressure roller 26 are shortened, the pressure roller 23 presses the gap located between the pressure roller 25 and the pressure roller 26, and the pressure roller 25 presses the gap between the fixing roller 22 and the pressure roller 23.

In a fixing device D shown in FIG. 5B, when compared with the configuration of the second embodiment, the pressure roller 34*a* is large and the pressure roller 35*a* is small. Since the pressure roller 35*a* is small, a belt guide member 33*a* close to the pressure roller 35*a* is located closer to the pressure roller 34*a* compared with the second embodiment. Because the pressure roller 34*a* has the low hardness, the pressure roller 34*a* is easy to deform. As a result, the pressure roller 34*a* presses the gap between the belt guide member 33*a* and the pressure roller 35*a*.

Fourth Embodiment

Then, a fourth embodiment will be described. First an entire configuration of an image forming apparatus will be described with reference to FIG. 12.

Figure 12:
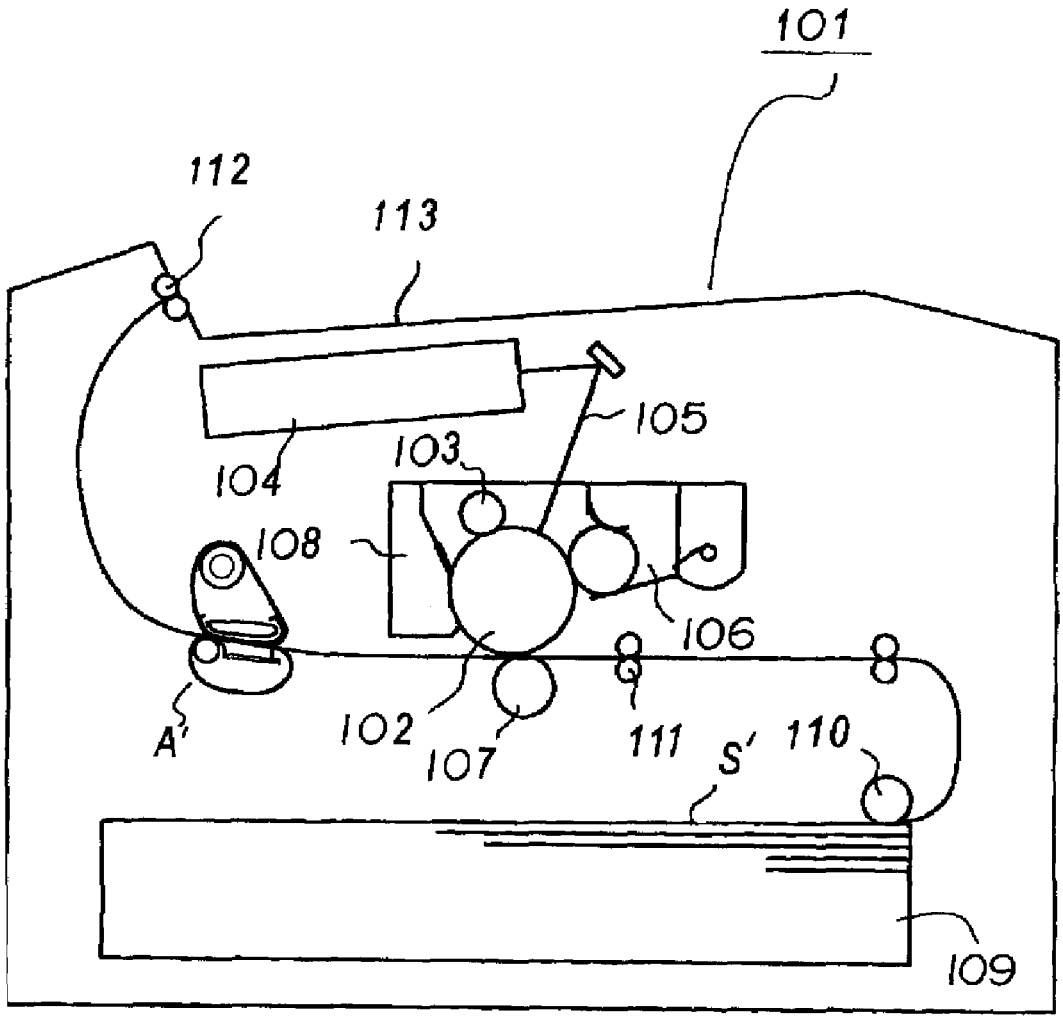
FIG. 12 is a view showing an entire configuration of an image forming apparatus.

The image forming apparatus shown in FIG. 12 is the image forming apparatus (so-called printer) in which the electrophotographic type is adopted.

An image forming apparatus 101 includes a photosensitive drum 102 which is of the image bearing member for bearing the latent image. The photosensitive drum 102 is uniformly charged by a charger 103, and the latent image is formed by irradiating the photosensitive drum 102 with a light beam 105 from an optical device 104. The latent image is developed to form the toner image by a development unit 106 which is of the development means for developing the latent image. The toner image is transferred to the sheet by a transfer roller 107 which is of the transfer means, and the toner remaining on the photosensitive drum 102 is removed by a cleaning device 108.

Sheets S' are prepared in a sheet cassette 109 in a lower portion of the image forming apparatus, and the sheet S' is fed by a sheet roller 110. The sheet S' is conveyed in synchronization with the image on the photosensitive drum 102 by a registration roller pair 111 which is of the conveyance means. The sheet S' is conveyed to a fixing device A' after the toner image is transferred. Then, the toner image is fixed to the sheet S' by the heating and the pressure in the fixing device A', and the sheet S' is discharged to and stacked on a discharge tray 113 in an upper portion of the apparatus by a discharge roller pair 112.

Figure 7:
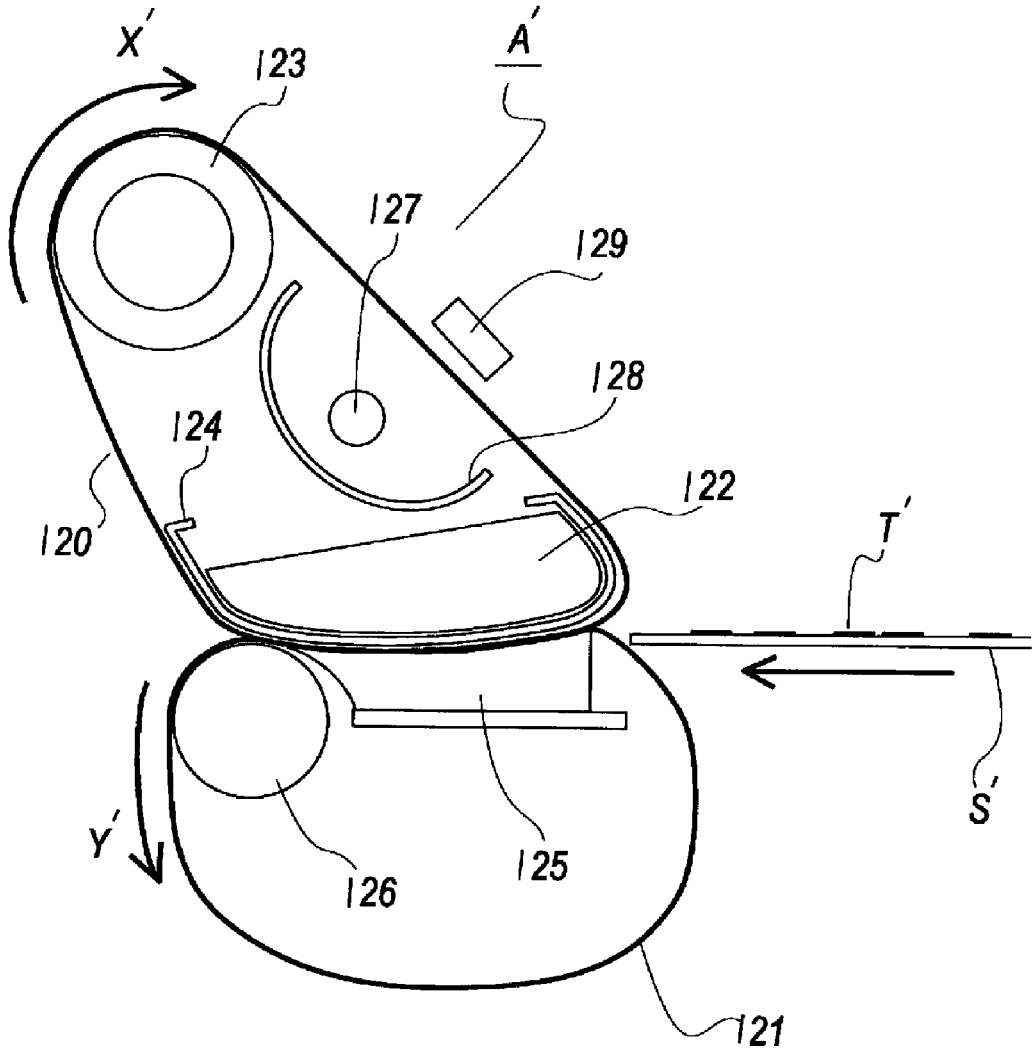
FIG. 7 is a sectional view showing a fixing device according to a fourth embodiment of the invention.
Figure 8:
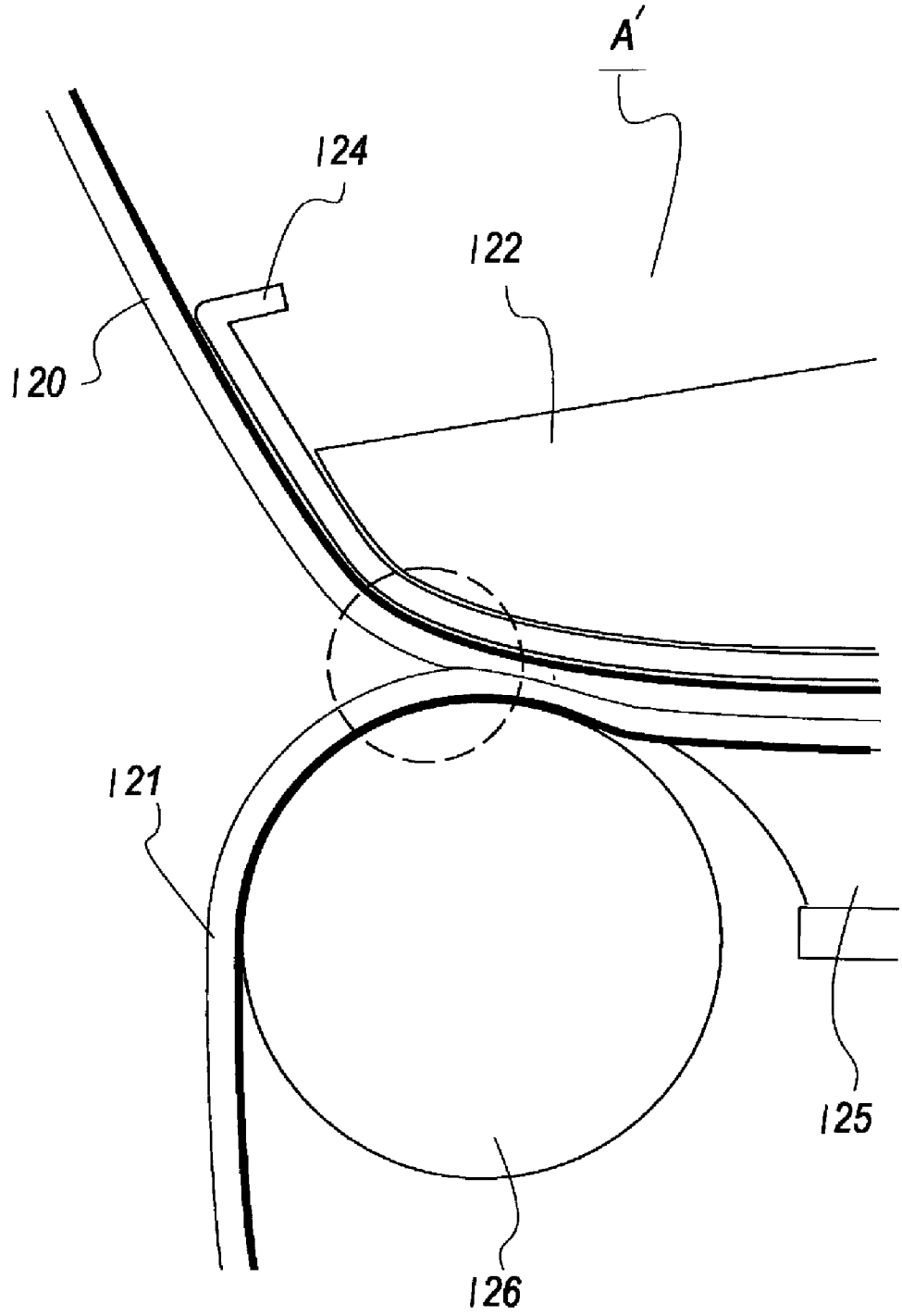
FIG. 8 is an enlarged sectional view showing a main part of the fixing device of the fourth embodiment.

FIG. 7 is a sectional view showing the fixing device A' according to the fourth embodiment of the invention, and FIG. 8 is an enlarged sectional view showing a main part of the fixing device A'.

As shown in FIG. 7, the fixing device A' includes a fixing belt 120 which is of the first belt and a pressure belt 121 which is of the second belt. In the fixing belt 120 and the pressure belt 121, the base layer is made of a heat-resistant resin (for example, polyimide) having the inner diameter of 34 mm and the thickness of 75 μm. The heat-resistant silicone rubber layer which is of the elastic layer is provided in the outer circumference of the base layer. The thickness of the elastic layer can be selected in the rage of 100 to 1000 μm. However, in order to decrease the heat capacity of the fixing belt to shorten the warm-up time, and in order to obtain the preferable fixed image in fixing the color image, the thickness of the elastic layer is set at 500 μm. In the silicone rubber, the hardness is 20 degrees (JIS-A), and the heat conductivity is 0.8 W/mK. The fluororesin layer (for example, PFA or PTFE) having the thickness of 30 μm which is of the surface mold-releasing layer is further provided in the outer circumference of the elastic layer. In order to decrease the slide friction with the fixing belt inclusion, the resin layer such as fluororesin and polyimide having the thickness ranging from 10 μm to 50 μm may be provided in the inner surface of the base layer. For example, the fluororesin layer having the thickness of about 10 μm is formed in the fourth embodiment.

The fixing belt 120 is supported by a fixing backup member 122 and a drive roller 123 which are of the first pressure member. The fixing backup member 122 is made of a resin, and the fixing backup member 122 is made of the poly phenylene sulfide resin (PPS) in the fourth embodiment. The fixing backup member 122 imparts the tension ranging from about 49N to about 98N to the fixing belt 120. Further, a fixing backup member cover 124 shown in FIG. 7 can be provided in order to decrease the frictional resistance with the inner surface of the fixing belt 120. A glass-fiber cloth coated with fluororesin, in which the glass-fiber cloth is fixed to the upstream portion in the rotating direction of the fixing belt 120 of the fixing backup member 122 by a machine screw or a polyimide sheet in which projections and recesses are provided to decrease the contact area can be used as the fixing backup member cover 124. The glass-fiber cloth coated with fluororesin is adopted in the fourth embodiment.

In the drive roller 123, the silicone rubber sponge layer is provided in the iron-alloy cored bar in order to decrease the heat conductivity to suppress the heat conduction from the fixing belt 120. In the iron-alloy cored bar, the outer diameter is 20 mm, the diameter in the center of the longitudinal direction is 16 mm, and the diameters of the both end portions are 14 mm. The hardness of the drive roller 123 in the center of the longitudinal direction is about 60 degrees by the ASK-C hardness tester. The reason why the cored bar is tapered is that the width of the pressure contact portion with fixing belt 120 becomes uniform in the longitudinal direction even if the drive roller 123 is bent when the tension is imparted to the fixing belt. The drive roller 123 is rotated by a motor (not shown), and the fixing belt 120 is rotated by the friction between the silicone rubber sponge surface of the drive roller 34 and the inner surface fluororesin layer of the fixing belt 120. Because the slide friction between the fixing backup member 122 and the fixing belt 120 is decreased by the fixing backup member cover 124, the fixing belt 120 can be rotated with no slip of the fixing belt 120

The pressure belt 121 is supported by a pressure pad 125 which is of the second pressure member and a pressure roller 126 which is of the third pressure member while pressed against the fixing belt 120. The pressure pad 125 which is of the first pressure member is made of a rubber material whose substrate is formed by a metal plate. In the pressure pad 125, the rubber having the hardness of 10 degrees (JIS-A) is formed with the thickness of 3 mm. The pressure pad 125 is molded so as to be inserted into the gap between the fixing backup member 122 and the pressure roller 126, and is arranged while abutting on the pressure roller 126. While the pressure pad 125 holds belt floating in the pressure contact portion between the fixing belt 120 and the pressure belt 121, the pressure pad 125 acts as a brake during rotating the belt because the pressure pad 125 applies the pressure to the belt in the static state. Therefore, it is preferable that the pressure pad 125 lightly applies the pressing force to an extent in which the floating is not generated between the belts. In the fourth embodiment, the pressure pad is set so as to apply the pressing force of about 196N to the fixing belt 120 (fixing backup member 122). The width in the rotating direction of the pressure contact portion between the fixing belt 120 and the pressure pad 125 is 15 mm.

The pressure roller 126 which is of the second pressure member is arranged on the downstream side of the pressure pad 125 while brought close to the pressure pad 125. The diameter of the pressure roller 126 is 18 mm in the center of the longitudinal direction, and the iron-alloy pressure roller 126 has normal crown ranging from 200 μm to 1000 μm (the roller diameter in the central portion is larger than other portion in the longitudinal direction). In the fourth embodiment, the normal crown amount is set at 400 μm. The reason why the pressure roller 126 is tapered in the normal crown is that the width of the pressure contact portion with the fixing backup member 122 becomes uniform in the longitudinal direction even if the pressure roller 126 is bent in pressing the pressure roller 126 when heated.

The pressure roller 126 is different from the pressure pad 125 in the function. The fixing belt 120 is elastically deformed by locally applying the high pressure (see portion shown by a broken like of FIG. 8), the toner surface and the fixing belt 120 are separated from each other by surface strain of the fixing belt 120. That is, the pressing force by the pressure roller 126 is increased higher than the pressing force by the pressure pad 125, and the pressure is maximized at the recording-material separation position located on the downstream-most side in the recording-material conveyance direction of the pressure contact portion. In the fourth embodiment, the pressure roller 126 is set so as to apply the pressing force of about 294N to the fixing belt 120 (fixing backup member 122). The width in the rotating direction of the pressure contact portion between the fixing belt 120 and the pressure roller 126 is about 3 mm, and it is found that the pressure per unit area is higher when compared with the pressure pad 125.

The pressure roller 126 and the pressure pad 125 are arranged while abutting to each other, which forms the continuous surface. The fixing backup member 122 presses the pressure roller 126 and the pressure pad 125.

In this case, the pressure contact portion of the fixing backup member 122 is not a flat surface but is curved so as to be swollen toward the side of the pressure belt 121 in the belt rotating direction. This is because there is a possibility that the gap is slightly formed between the pressure members when the plural pressure members opposite to the fixing backup member 122 exist. The configuration of the fourth embodiment enables the prevention of the pressure-absence region when the gap exists, however the pressure-absence region is generated when the fixing backup member 122 is curved so as to be retracted from the pressure belt 121.

A halogen heater 127 is arranged inside the fixing belt 120 for the purpose of the heat source of the fixing device A'. In consideration of thermal efficiency to the fixing belt 120, a reflector plate 128 is arranged near the halogen heater 127. The heater of 800 W/h is used as the halogen heater 127 of the fourth embodiment. A non-contact type temperature sensor is used as a temperature sensor 129, and the temperature sensor 129 is placed outside the fixing belt 120 while being opposite to the halogen heater 127. The electric power supply to the halogen heater 127 is controlled according to the output of the temperature sensor 129.

At least in performing the image formation, the drive roller 123 is rotated by drive means (not shown) to rotate the fixing belt 20 in an arrow X' direction of FIG. 7, and the pressure roller 126 is similarly rotated by drive means (not shown) to rotate the pressure belt 121 in an arrow Y' direction. The circumferential speed of the fixing belt 120 is substantially equal to the conveyance speed of the sheet S' which is conveyed from the image transfer portion side. In the fourth embodiment, the surface rotating speed of the fixing belt 120 is 160 mm/sec, and 40 A4-size full-color images can be fixed for one minute.

In the temperature-adjusted state in which the fixing belt 120 reaches to the predetermined fixing temperature, the sheet S' having the unfixed toner image T is conveyed between the fixing belt 120 and the pressure belt 121 in the pressure contact portion. The sheet S' is introduced while the surface on which the unfixed toner image is borne is orientated toward the side of the fixing belt 120. The unfixed toner image T side of the sheet S' comes into close contact with the circumferential surface of the fixing belt 120, and the pressure contact portion is sandwiched and conveyed with the fixing belt 120. Therefore, the heat of the fixing belt 120 is mainly imparted, and the unfixed toner image T is thermally fixed onto the surface of the sheet S' by receiving the pressing force of the pressure contact portion.

At this point, because the fixing backup member 122 continuously presses the sheet passing through the pressure pad 125 which is of the first pressure member, the sheet S' is conveyed to the pressure roller 126 which is of the second pressure member while being close contact with the fixing belt 120. As shown in FIG. 8, in the pressure roller 126 which is of the second pressure member, the elastic layer located in the outer circumference of the fixing belt 120 is locally deformed by the pressure roller 126, the sheet S' is easily separated by itself from the fixing belt 120 and conveyed outside the fixing device.

The pressure pad 125 and the pressure roller 126 can be moved by a cam (not shown) so as to be brought into contact with and separated from the fixing belt 120. The pressure belt 121 is separated from the fixing belt 120 by this mechanism except in the fixing operation. Therefore, since the heat of the fixing belt 120 is not transferred to the pressure belt 121, when the electric power of 1200 W is inputted to the halogen heater 127, about 30-second warm up time of the fixing device A' is required to heat the fixing belt 120 to 170° C. which is of the target temperature in the state where the pressure belt 121 is separated from the fixing belt 120.

The relatively light pressing force is applied to the rotating fixing belt 120, so that runout movement force toward the width direction (direction orthogonal to the rotating direction) is small even in the rotating state. That is, since the force shifting the fixing belt 120 toward the width direction is small, it is only necessary that a flange member which simply receives an end portion of the fixing belt 120 is provided as means for controlling the runout in the width direction of the belt. Therefore, there is the advantage that the configuration of the fixing device A' can be simplified.

In the description of the fourth embodiment, the fixing backup member 122 is provided in the fixing belt 120, and the pressure pad 125 and the pressure roller 126 are provided in the pressure belt 121. Alternatively the fixing backup member 122 is provided in the pressure belt 121 and the pressure pad 125 and the pressure roller 126 are provided in the fixing belt 120, which allows the effects of the invention to be obtained just the same.

Thus, even if the fixing is performed using the belt member, the toner image can be fixed without generating the image shift and gloss unevenness by arranging the fixing backup member having the continuous surface shape in the pressure contact portion between the belts. The stable separation property between the sheet and the belt and the conveyance properties of the sheet and the belt can be realized by arranging the pressure member is arranged while the pressure member are broken down into the function.

Fifth Embodiment

Figure 9:
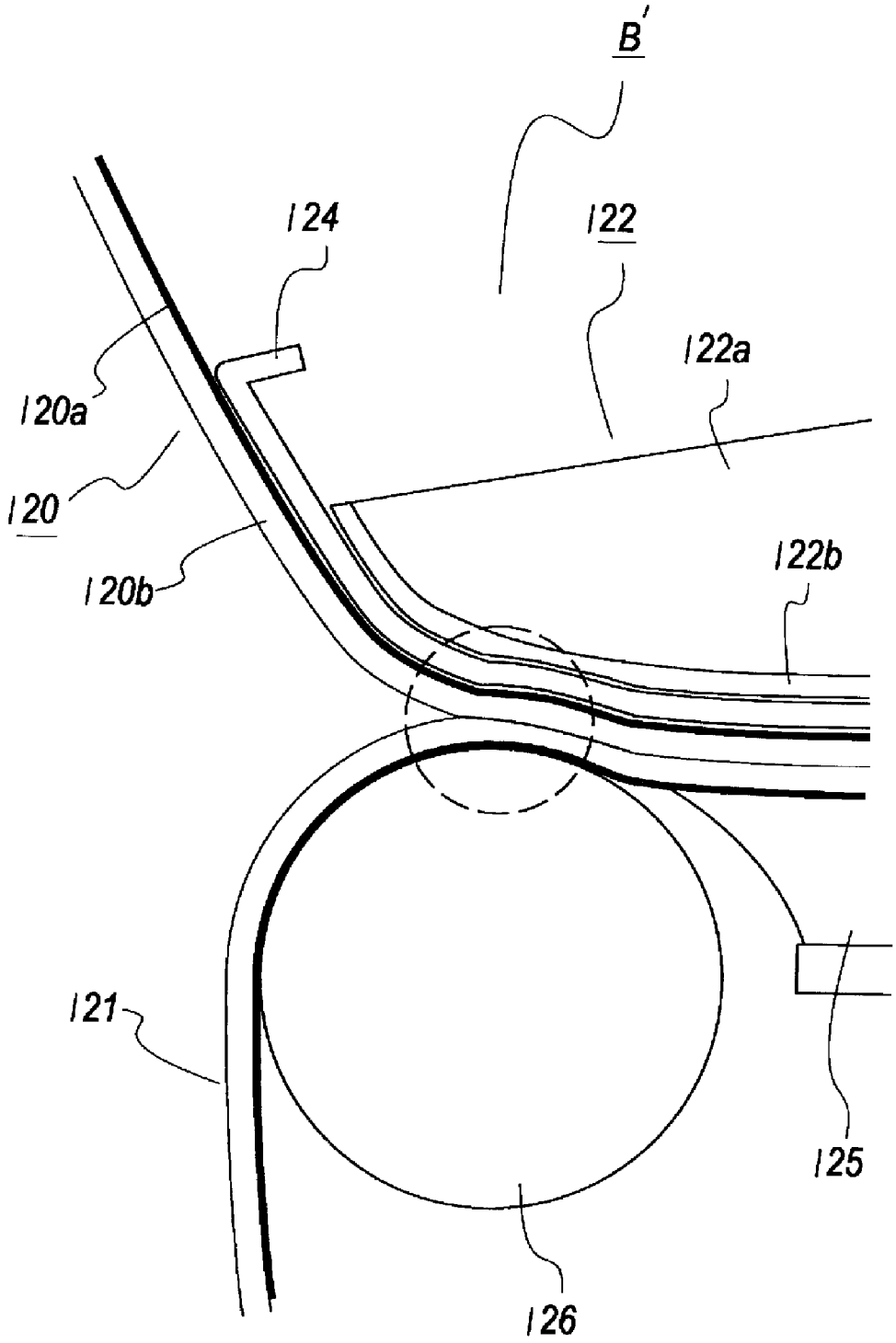
FIG. 9 is an enlarged sectional view showing a main part of a fixing device according to a fifth embodiment of the invention.

A fixing device and an image forming apparatus according to a fifth embodiment of the invention will be described below. FIG. 9 is an enlarged sectional view showing a main part of a fixing device B' according to the fifth embodiment of the invention. In the fifth embodiment, the component overlapping the fourth embodiment is designated by the same numeral, and the description will not be shown.

In description of the fourth embodiment, the elastic layers are provided in the outer circumferences of the base layers of the fixing belt 120 and the pressure belt 121, and the fixing backup member 122 is simply made of the resin. On the other hand, in the fixing device B' of the fifth embodiment, the elastic body is also formed in the surface of the fixing backup member which is of the first pressure member.

In the fixing backup member 122 shown in FIG. 9, substrate 122*a* is made of the heat-resistant resin such as PPS or metal. An elastic layer 122*b* formed by the heat-resistant elastic body such as the silicone rubber is formed on the pressure contact portion side of the substrate 122*a*. The elastic layer 122*b* is in direct contact with the fixing-belt inner surface or in contact with the fixing-belt inner surface through a film having a sliding property. In the fifth embodiment, the elastic layer 122*b* whose thickness is 1 mm is formed by the rubber having 40 degrees (JIS-A).

At this point, a hardness relationship between the elastic layer 122*b* and the elastic layer 120*b* (shaded portion) formed in the fixing belt 120 is set such that the hardness of the elastic layer 122*b* in the fixing backup member 122 is higher than the hardness of the elastic layer 120*b* in the fixing belt 120. In the fifth embodiment, the substrate 120*a* of the fixing belt 120 is made of polyimide, the elastic layer 120*b* whose thickness is 500 μm is formed by the rubber having 20 degrees (JIS-A), and the PFA surface layer having the thickness of 30 μm is provided.

The above configuration of the fifth embodiment enables not only the elastic layer 120*b* on the surface of the fixing belt 120 but also the substrate 120*a* to be deformed in the pressure roller 126 which is of the second pressure member. Accordingly, a curvature of the exit portion of the pressure contact portion is further decreased, so that the separation property can be improved between the sheet S' and the fixing belt 120.

Sixth Embodiment

Figure 10:
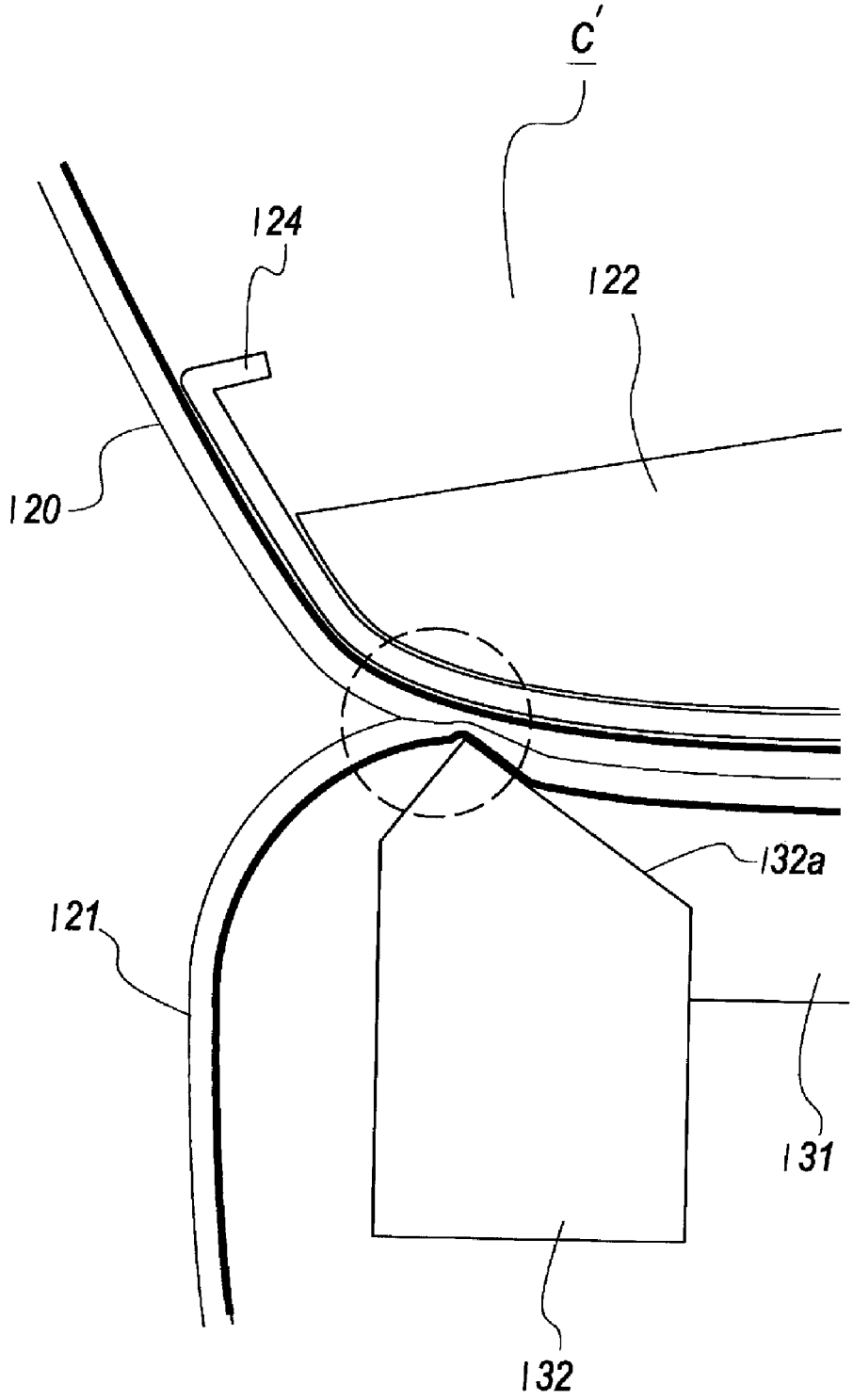
FIG. 10 is an enlarged sectional view showing a main part of a fixing device according to a sixth embodiment of the invention.

A fixing device and an image forming apparatus according to a sixth embodiment of the invention will be described below. FIG. 10 is an enlarged sectional view showing a main part of a fixing device C' according to the sixth embodiment of the invention. In the sixth embodiment, the component overlapping the fourth embodiment is designated by the same numeral, and the description will not be shown.

In the configuration of the fourth embodiment, the pressure pad 125 and the pressure roller 126 are provided as the pressure member. On the other hand, in the fixing device C' of the sixth embodiment, a block member formed by a rigid material is used instead of the pressure roller 126.

As shown in FIG. 10, a pressure block 132 which is of the block member is arranged on the downstream side of a pressure pad 131. The pressure block 132 is a rigid body which is not easily deformed, and is made of metal such as aluminum and stainless steel. An inclined surface 132*a* is formed on the pressure contact portion side of the pressure block 132, and the inclined surface 132*a* is gradually protruded toward the fixing backup member 122 along the downstream side in the rotating direction. That is, the pressure block 132 is formed in the protruded shape on the side of the fixing belt 120 while the thickness of the pressure block 132 is gradually thinned toward a front end.

Although the pressure pad 131 is made of the same material as the fourth embodiment, the pressure pad 131 is arranged close to the pressure block 132 arranged on the downstream side of the pressure pad 131. Therefore, the surface on the pressure contact portion side of the pressure member is continuously formed in the pressure belt 121 and the continuous pressing property can further be improved, so that the image shift and the gloss unevenness can be prevented more securely.

When compared with the use of the pressure roller 126, the elastic layer 120*b* of the surface layer of the fixing belt 120 can further locally be deformed in the exit portion of the pressure contact portion. Accordingly, the separation property can further be improved between the sheet S' and the fixing belt 120.

In the sixth embodiment, the pressure pad 131 and the pressure block 132 are described to be the pressure members which are separated from each other. Alternatively, the pressure block 132 may be fixed to the metal plate which is of the substrate of the pressure pad 131 to integrally form the pressure pad 131 and the pressure block 132.

The pressure belt 121 is driven to rotate in accordance with the fixing belt 120 in the sixth embodiment. Alternatively, a drive roller (not shown) may be introduced into the pressure belt 121. Therefore, the slip of the pressure belt 121 can be prevented and the conveyance property can be improved. As described in the fifth embodiment, the separation property and the conveyance property can further be improved by providing the elastic layer 122*b* in the fixing backup member 122.

Thus, the pressure member on the exit side of the pressure contact portion is formed in the block shape, and thereby the continuity with the pressure pad can be increased and the toner image can be fixed with a simple configuration while the image shift and the gloss unevenness are not generated. Since the surface layer of the fixing belt can further locally be deformed in the exit portion of the pressure contact portion, the separation property between the sheet and the belt and the conveyance properties of the sheet and belt can be realized more stably.

Seventh Embodiment

Figure 11:
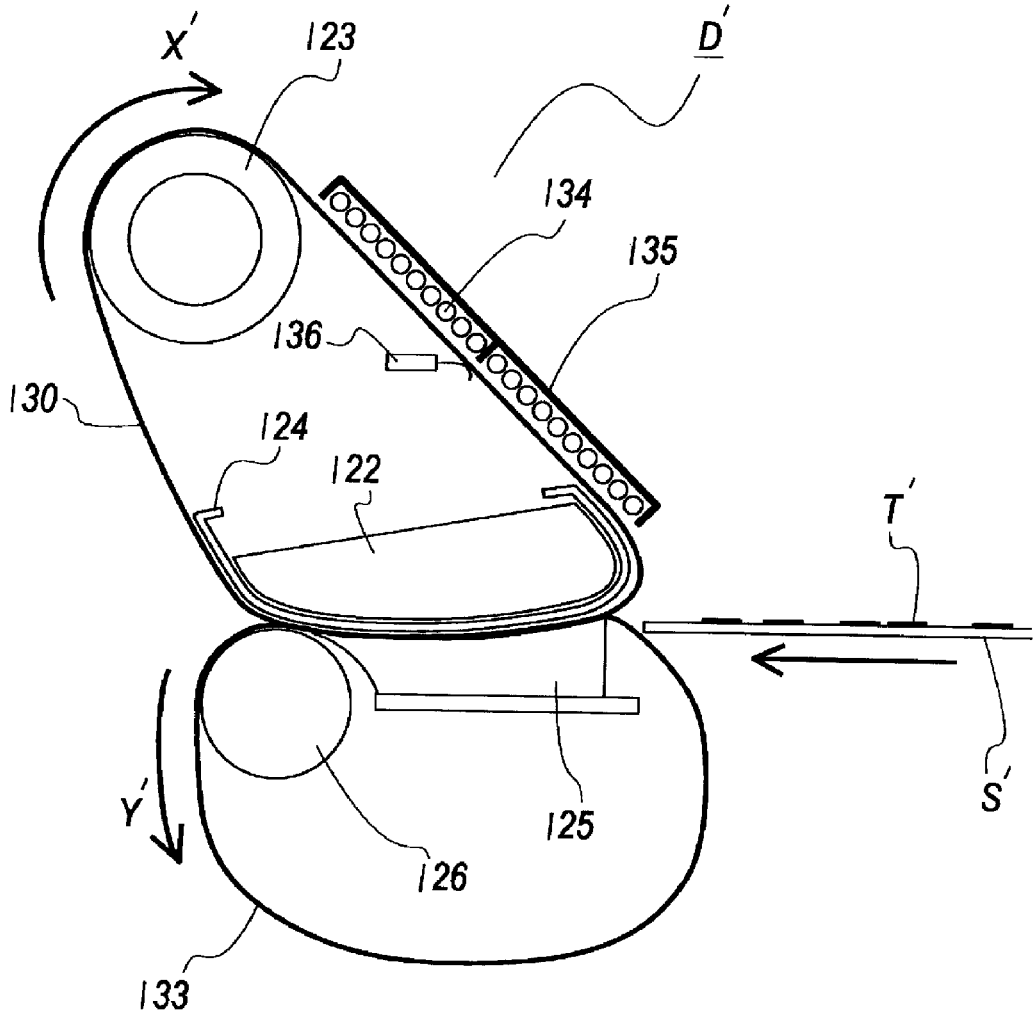
FIG. 11 is a sectional view showing a fixing device according to a seventh embodiment of the invention.

A fixing device and an image forming apparatus according to a seventh embodiment of the invention will be described below. FIG. 11 is a sectional view showing a fixing device D' according to the seventh embodiment of the invention. In the seventh embodiment, the component overlapping the fourth embodiment is designated by the same numeral, and the description will not be shown.

The induction heating type is adopted for the halogen heater 127 which is of the heat source of the fourth embodiment. In the induction heating type, the metal and the induction heating coil are used in the fixing belt substrate. Therefore, the seventh embodiment has the features that the thermal efficiency is improved, the warm-up time is shortened, and the energy saving can be achieved without losing the above effects.

In the fixing device D' shown in FIG. 11, a fixing belt 130 has the base layer which is made of metal layer of nickel produced by the electro-casting. In the base layer, the inner diameter is 34 mm and the thickness is 50 μm. As with the fourth embodiment, the elastic layer and the mold-releasing layer are provided in the outer circumference of the base layer. The polyimide layer having the thickness of 20 μm is provided in the inner surface of the fixing belt 130 in order to decrease the slide friction with the fixing belt inclusion.

In a pressure belt 133, the base layer is made of polyimide having the inner diameter of 34 mm and the thickness of 70 μm, and the PFA tube made of fluororesin having the thickness of 30 μm is provided as the mold-releasing layer in the surface. In order to decrease the slide friction with a later-mentioned belt guide 113, fluororesin particles may be dispersed in polyimide which is of the base layer.

An induction heating coil 134 which is of the magnetic-field generation means is provided along the fixing belt 130, and the induction heating coil 134 is the heat source of the fixing device D'. The induction heating coil 134 is covered with a magnetic core 135 such that the magnetic field generated by the induction heating coil 134 does not leak outside the metal layer of the fixing belt 130. Further, the induction heating coil 134 and the magnetic core 135 are integrally molded with the electric insulating resin. The electric insulating state is kept between the fixing belt 130 and the induction heating coil 134 by the 0.5 mm mold, and the distance between the fixing belt 130 and the induction heating coil 134 is kept constant at 1.5 mm (distance between the mold surface and the fixing belt surface is 1.0 mm), so that the fixing belt 130 is uniformly heated. The induction heating coil 134 is formed such that the length along the sheet-pass direction of the sheet S' (direction orthogonal to the belt rotating direction) is longer than the sheet-pass width of the sheet S' having the maximum sheet-pass width used in the image formation. The high-frequency current ranging from 20 kHz to 50 kHz is passed through the induction heating coil 134 to generate the induced heat in the metal layer of the fixing belt 130. The temperature is adjusted so as to be kept constant at 170° C., which is the target temperature of the fixing belt 130, by changing the frequency of the high-frequency current to control the electric power inputted to the induction heating coil 134 based on the detection value of a temperature sensor 136. The silicone rubber sponge layer of the pressure roller 123 has the thickness of at least 2 mm, and the cored bar is hardly heated by the induction heating coil 134. Therefore, in the seventh embodiment, only the fixing belt 130 can efficiently be heated.

The temperature sensor 136 is in contact with the position where the heat generation amount by the induction heating coil 134 becomes the maximum, and the temperature sensor 136 detects the temperature of the position. Since the metal layer of the fixing belt 130 generates the heat, when the temperature sensor 136 is arranged like the seventh embodiment, the temperature of the fixing belt 130 can be detected with extremely high accuracy and at high response speed. The position where the heat generation amount of the fixing belt 130 becomes the maximum is each central portion in the belt rotating direction of the two divided portions of the induction heating coil 134 shown in FIG. 11.

As with the fourth embodiment, the pressure pad 125 and the pressure roller 126 can be moved so as to be brought into contact with and separated from the fixing belt 130. When the electric power of 1200 W, for example, is inputted to the induction heating coil 134, about 15-second warm-up time is required to heat the fixing belt 130 to 170° C. which is of the target temperature in the state where the pressure belt 133 is separated from the fixing belt 130.

Thus, in the seventh embodiment, the induction heating type is adopted for the heat source, which allows the warm-up time to be shortened without losing the effects described in the fourth embodiment. The heat source with the induction heating coil described in the seventh embodiment can be applied to the configurations described in the fifth and sixth embodiments, and the same effects can be obtained.

As described above, according to the first to seventh embodiments, the nip which heats the image while sandwiching and conveying the recording material is formed only by the region which is pressed by pressure elements (roller and pad) of the fixing belt and the pressure belt. Therefore, the region where the nip pressure is largely decreased can be eliminated and the image disturbance can be prevented in heating the image.

CROSS-REFERENCE TO RELATED APPLICATION

This application claims the benefit of priority from the prior Japanese Patent Application No. 2004-359593 filed on Dec. 13, 2004 and Japanese Patent Application No. 2004-359592 filed on the same day the entire contents of which are incorporated by reference herein.

What is claimed is:

1. An image heating device comprising:

a first belt which heats an image on a recording material at a nip;

a second belt which forms the nip with said first belt;

a first pressure pad, slidable to said first belt, which presses said first belt toward said second belt at the nip; and a second pressure pad, slidable to said second belt, which presses said second belt at the nip so that said first belt and said second belt are sandwiched by said first pressure pad and said second pressure pad; and, a pressure roller, disposed at a downstream side of said second pressure pad in a recording material conveying direction, which presses said second belt at the nip so that said first belt and said second belt are sandwiched by said first pressure pad and said pressure roller;

wherein a pressure in the nip is highest at a exit region, of the nip, where said first belt and said second belt are pressed by said first pressure pad and pressure roller.

* * * * *

UNITED STATES PATENT AND TRADEMARK OFFICE

CERTIFICATE OF CORRECTION

PATENT NO. : 7,406,288 B2
APPLICATION NO. : 11/275017
DATED : July 29, 2008
INVENTOR(S) : Ikuo Nakamoto et al.

It is certified that error appears in the above-identified patent and that said Letters Patent is hereby corrected as shown below:

TITLE PAGE
(56) Reference Cited, Foreign Patent Document, "JP 07219366A* 8/1995 should be deleted;
(56) Reference Cited, Foreign Patent Document, "JP 11174878A* 7/1999 should be deleted;
(56) Reference Cited, Foreign Patent Document, "JP 2002221866A should read --2002-221866A--;
(57) Abstract, Line 2, "comprising," should read --comprising:--;

COLUMN 5
Line 6, "exist" should read --exit--.

COLUMN 11
Line 47, "rage" should read --range--;
Line 65, "poly phe-" should read --polyphe- --.

COLUMN 12
Line 31, "120" should read --120.--.

COLUMN 13
Line 6, "like" should read --line--.

COLUMN 18
Line 44, "at a" should read --at an--.
Line 46, "and" should read --and said--.

Signed and Sealed this

Twenty-fourth Day of March, 2009

John Doll

JOHN DOLL
*Acting Director of the United States Patent and Trademark Office*